US007223951B2

(12) United States Patent
Jung

(10) Patent No.: US 7,223,951 B2
(45) Date of Patent: May 29, 2007

(54) COOKING CONTROL METHOD OF MICROWAVE OVEN AND APPARATUS FOR PERFORMING THE SAME

(75) Inventor: Jin Hee Jung, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 11/183,975

(22) Filed: Jul. 19, 2005

(65) Prior Publication Data

US 2006/0151486 A1 Jul. 13, 2006

(30) Foreign Application Priority Data

Jan. 3, 2005 (KR) ..... 10-2005-0000291

(51) Int. Cl.
*H05B 6/68* (2006.01)
*H05B 6/78* (2006.01)

(52) U.S. Cl. ..... 219/708; 219/754; 219/518; 99/451; 99/325

(58) Field of Classification Search ..... 219/708, 219/702, 704–705, 752–755, 518; 99/451, 99/325, DIG. 14; 177/245
See application file for complete search history.

(56) References Cited

U.S. PATENT DOCUMENTS 4,683,967 A * 8/1987 Hanatani et al. ..... 177/144
4,895,067 A * 1/1990 Ohji et al. ..... 99/325
5,302,792 A 4/1994 No et al.
5,422,464 A 6/1995 Jeon
5,463,207 A 10/1995 Kang

FOREIGN PATENT DOCUMENTS

| | | | | |
|---|---|---|---|---|
| EP | 0 552 807 | | 7/1993 | |
| EP | 1 477 782 | | 11/2004 | |
| EP | 1 487 241 | | 12/2004 | |
| JP | 2-68426 | * | 3/1990 | ..... 219/708 |
| JP | 5-203158 | * | 8/1993 | ..... 219/708 |
| JP | 5-240444 | * | 9/1993 | ..... 219/708 |
| KR | 1994-009034 | | 4/1994 | |
| KR | 1998-0005831 | | 2/1998 | |
| KR | 1998-0059625 | | 12/1998 | |
| KR | 1999-0015840 | | 5/1999 | |

OTHER PUBLICATIONS

European Search Report issued Apr. 25, 2006.

* cited by examiner

*Primary Examiner*—Philip H. Leung
(74) *Attorney, Agent, or Firm*—Staas & Halsey LLP

(57) ABSTRACT

A method for controlling microwave output depending upon food weight and food position so as to implement optimized cooking performance in a microwave oven and an apparatus for performing the same. According to the control method for cooking food placed on a turntable in a microwave oven, the control method includes detecting a plurality of sensing values generated based on the food weight during the rotation of the turntable, detecting a food position by comparing the detected sensing values, and controlling the microwave output based on the detected food position.

20 Claims, 8 Drawing Sheets

COOKING CONTROL METHOD OF MICROWAVE OVEN AND APPARATUS FOR PERFORMING THE SAME

CROSS-REFERENCE TO RELATED APPLICATIONS

This application claims the benefit of Korean Patent Application No. 2005-0000291, filed on Jan. 3, 2005, in the Korean Intellectual Property Office, the disclosure of which is incorporated herein by reference

BACKGROUND OF THE INVENTION

1. Field of the Invention

The present invention relates to a microwave oven for detecting the food position using a weight sensor, and more particularly to a method for controlling the microwave output depending upon a weight and food position to be cooked so as to implement optimized cooking performance in a microwave oven and an apparatus for performing the same.

2. Description of the Related Art

Generally, a microwave oven is a cooking device for rapidly heating food using microwaves at a frequency of about 2,450 MHz, which are generated when high voltage electricity is applied to a magnetron, a device for generating high frequency microwaves, and vibrate water molecules contained in food, so that the food is rapidly cooked by heat generated due to the vibration of the water molecules.

Such a microwave oven detects the food weight using a weight sensor, and a microwave oven using a weight sensor is disclosed in Korean Utility Model Registration No. 0118078.

The microwave oven in Korean Utility Model Registration No. 0118078 detects the food weight and controls cooking time and microwave output based on the detected food weight.

There are several types of weight sensors, such as a differential coil type weight sensor, a capacitance type weight sensor, a piezo-electric type weight sensor, a strain gage type weight sensor, and the like, and conventional weight sensors detect the food weight while the food is supported by a turntable.

Since a conventional microwave oven controls the microwave output only by taking account of the food weight without taking account of the fact that food is not cooked uniformly and microwave energy transmitted to the food varies according to the position of the food on the turntable, the cooking performance of the conventional microwave oven varies depending upon whether the food is located at the center or the side of the turntable.

SUMMARY OF THE INVENTION

Accordingly, it is an aspect of the present invention to provide a method for controlling the microwave output based on weight of food and food position so as to implement optimized cooking performance in a microwave oven and an apparatus for performing the same.

Additional aspects and/or advantages of the invention will be set forth in part in the description which follows and, in part, will be apparent from the description, or may be learned by practice of the invention.

It is another aspect of the present invention to provide a method for precisely detecting the food position placed on a turntable using a weight sensor so as to supply a proper amount of microwave energy to the food and an apparatus for performing the same.

The foregoing and/or other aspects of the present invention are achieved by providing a control method for cooking food placed on a turntable in a microwave oven, including detecting a plurality of sensing values generated according to weight of food to be cooked during the rotation of the turntable, detecting a food position by comparing the detected sensing values, and controlling the microwave output based on the detected food position.

The sensing values are peak voltage values detected according to a pressure applied corresponding to the weight of food.

Further, the sensing values are peak voltage values detected for a period of one revolution or at least two revolutions of the turntable.

The food position is a distance of the food from a center of the turntable, and the output of the microwave is increased as the food position is farther from the center of the turntable.

The control method further includes detecting the weight of food based on the detected sensing values, and detecting the food position by classifying the detected weight of food.

The weight of food is a value corresponding to an average of the sensing values and is detected as a same value regardless of the food position.

The food position is estimated by obtaining a maximal value and a minimal value among the detected sensing values and by substituting a difference between the maximal value and the minimal value into a weight formula, wherein the weight formula is predetermined.

The maximal value is a maximal voltage value obtained by subtracting an initial voltage value from a greatest value among the sensing values, and the minimal value is a minimal voltage value obtained by subtracting an initial voltage value from a lowest value among the sensing values.

It is another aspect of the present invention to provide a controlling apparatus of a microwave oven for cooking food placed on a turntable, including a weight sensor to detect a plurality of sensing values generated corresponding to food weight, during a rotation of the turntable, and a controller to detect a food position of the food by comparing the detected sensing values, and to control the microwave output based on the detected food position.

The controller controls the microwave intensity and microwave output time based on the food position.

The sensing values are peak voltage values detected when a plurality of rollers that are installed in a lower side of the turntable passes by the weight sensor according to a pressure corresponding to the food weight is applied.

The rollers are at least three rollers, which are disposed radially every 120 degrees. However, the number of rollers is not limited hereto, and may vary accordingly.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE PREFERRED EMBODIMENTS

Figure 1:
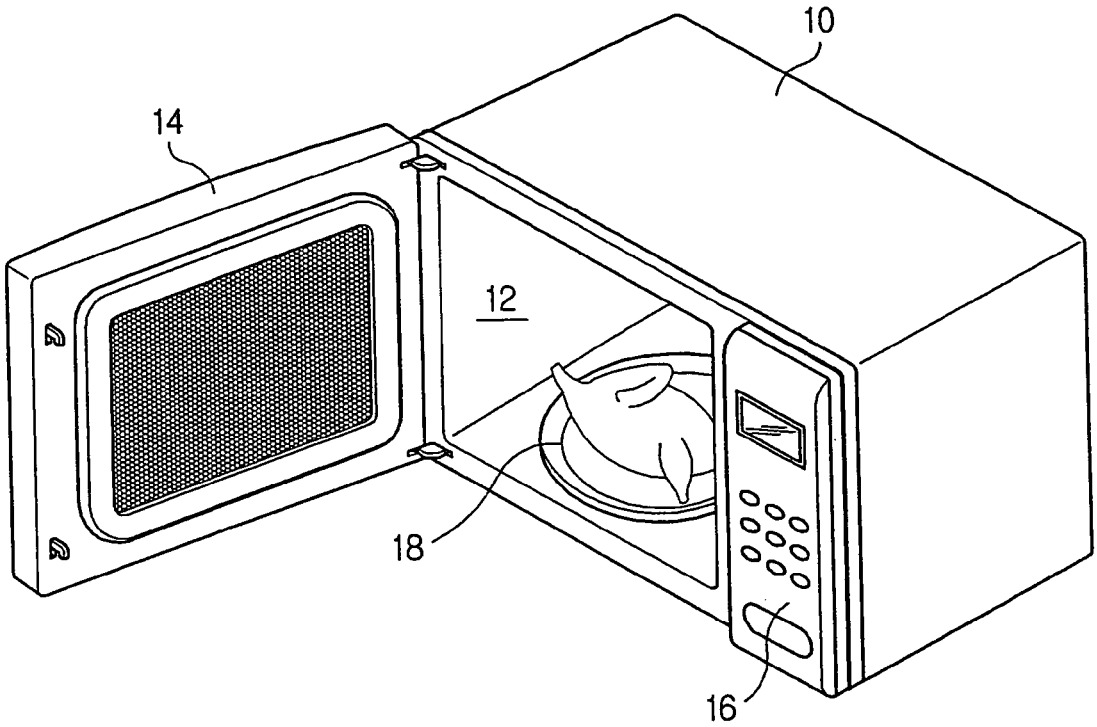
FIG. 1 is a schematic perspective view illustrating a microwave oven including an embodiment of the present invention.

Reference will now be made in detail to the embodiments of the present invention, examples of which are illustrated in the accompanying drawings, wherein like reference numerals refer to the like elements throughout. The embodiments are described below to explain the present invention by referring to the figures.

FIG. 1 is a schematic perspective view illustrating a microwave oven including an embodiment of the present invention.

As shown in FIG. 1, a cavity 12 is formed in a body 10, a door 14 is installed to the front side of the cavity 12 to pivot, and a manipulation panel 16 is installed to the right side of the cavity 12. When a user selects cooking function using the manipulation panel 16, the manipulation panel 16 displays the selected cooking function.

At an inner lower side of the cavity 12, a turntable 18 for rotating the food, on which food is placed, is installed.

Figure 2:
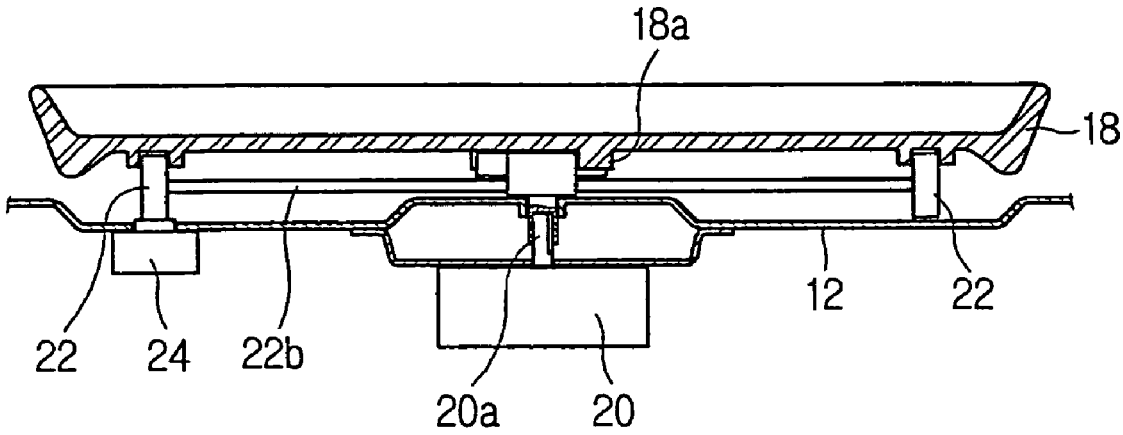
FIG. 2 is a sectional view illustrating main parts of the microwave oven of FIG. 1.
Figure 3:
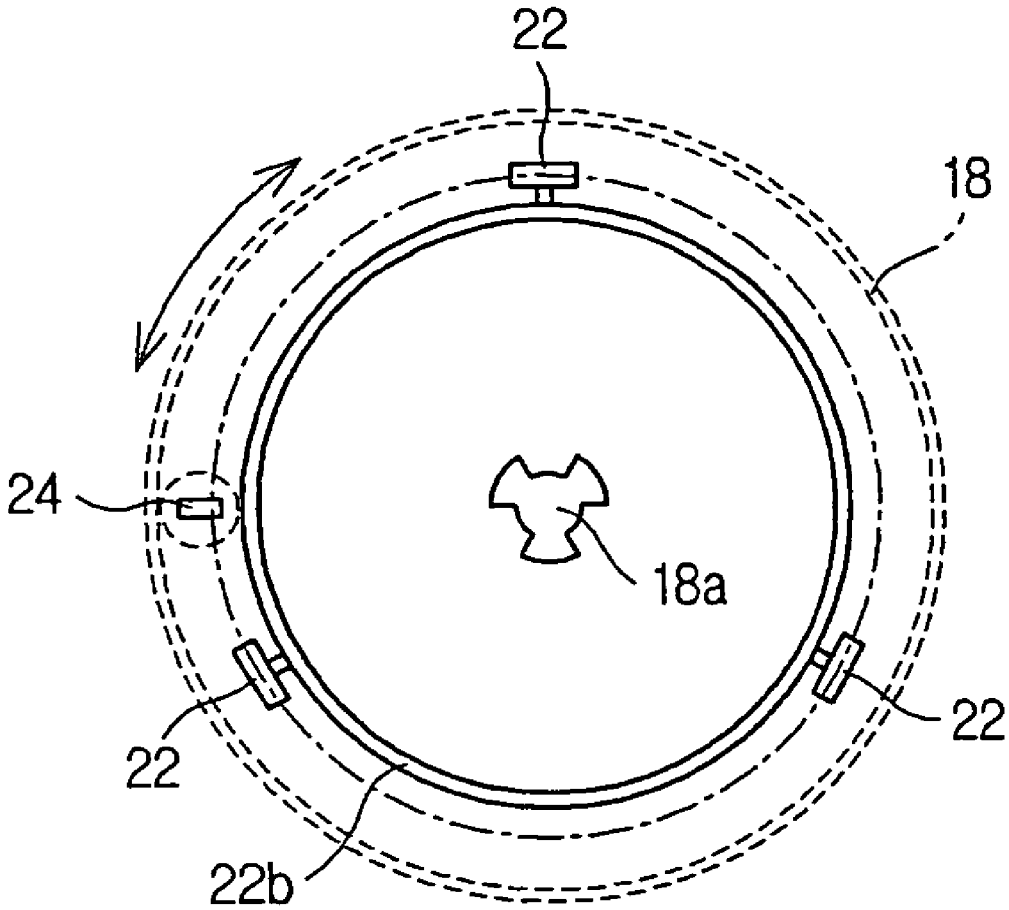
FIG. 3 is a view illustrating a turning passage of rollers and a position of a sensor of the microwave oven according to an embodiment of the present invention.
Figure 4:
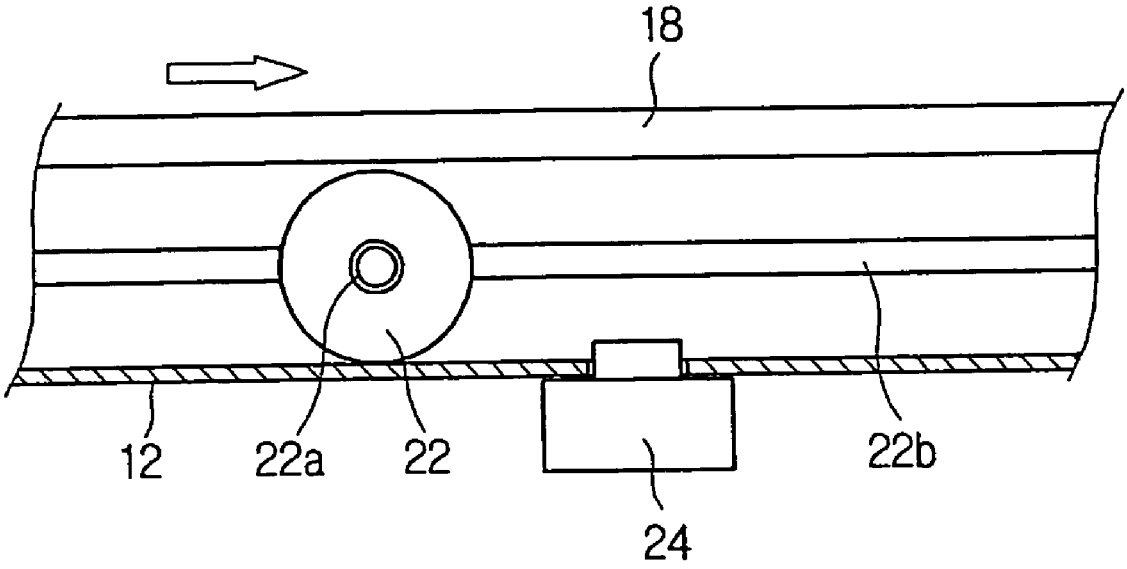
FIG. 4 is a view illustrating a contact of the rollers with the sensor during the rotation of the rollers in the cavity of the microwave oven according to an embodiment of the present invention.

FIG. 2 is a sectional view illustrating main parts of the microwave oven of FIG. 1, FIG. 3 is a view illustrating a turning passage of rollers and the position of a sensor of the microwave oven according to an embodiment of the present invention, and FIG. 4 is a view illustrating the contact of the rollers with the sensor during the rotation of the rollers in the cavity of the microwave oven according to an embodiment of the present invention.

As shown in FIGS. 2 to 4, a turntable motor 20 for rotating the turntable 18 is installed at the lower side of a center shaft of the turntable 18 by a connecting shaft 20*a*, and a center coupler 18*a*, rotated on the bottom surface of the cavity 12, for supporting the turntable 18, is installed to the connecting shaft 20*a*.

A plurality of rollers (i.e., approximately three rollers) 22 is rotatably installed to roller supporting shafts 22*a* (see FIG. 4) on the lower surface of the turntable 18. The rollers 22 rotate around the connecting shaft 20*a* during the rotation of the turntable 18, and rotate about the roller supporting shafts 22*a*. The rollers 22 are disposed radially every 120 degrees.

The rollers 22 travel along a rotating passage. At a lower side of the rotating passage, a weight sensor 24 penetrates the cavity 12. The weight sensor 24 generates an output signal corresponding to the food weight whenever the rollers 22 travel over the weight sensor 24 while the rollers 22 generate a rotating force turn with a roller guide 22*b*. The weight sensor 24 is a pressure sensor to generate voltage when a pressure corresponding to the food weight on the turntable 18 is applied thereto.

The food weight is detected by performing an algorithm for estimating the food weight, for example, by averaging three sensing values, which are generated by the three contacts of the rollers 22 for one revolution of the turntable 18 when the number of the rollers 22 is three or by using sensing values for two more revolutions of the turntable 18.

Figure 5:
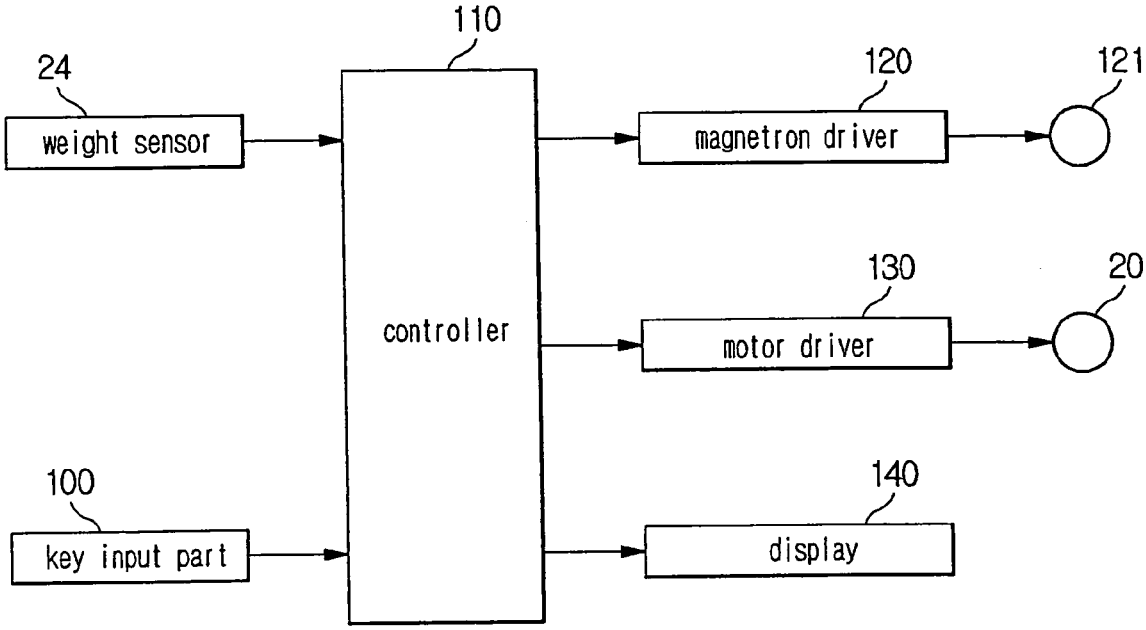
FIG. 5 is a block diagram illustrating the structure of a cooking control apparatus of a microwave oven according to an embodiment of the present invention.

FIG. 5 is a block diagram view illustrating the structure of a cooking control apparatus of a microwave oven according to an embodiment of the present invention. The cooking control apparatus includes the weight sensor 24, a key input part 100, a controller 110, a magnetron driver 120, a motor driver 130, and a display 140.

The key input part 100 is provided in the manipulation panel 16 and includes a plurality of keys (not shown) through which a user inputs cooking functions such as cooking time, menu, microwave output, start/stop, or the like, to the controller 110.

The controller 110 is a microcomputer for overall control of the microwave oven, and controls the output of the microwaves by detecting the food weight W and food position L according to the sensing values, that is, peak voltages $V_{MAX1}$, $V_{MAX2}$, and $V_{MAX3}$ generated by the weight sensor 24, during one period (for example, when the number of rollers is three) for one revolution of the turntable 18.

The magnetron driver 120 generates microwaves according to a control signal from the controller 110 and includes a relay for controlling a magnetron 121. The motor driver 130 controls the turntable motor 20 according to the control signal from the controller 110.

The display 140 displays the cooking time, the menu, or the like selected by the user on the manipulation panel 16 according to the control signal from the controller 110.

Hereinafter, operation and effect of the cooking control apparatus of the microwave oven and the cooking control method according to an embodiment of the present invention will be described.

Figure 6:
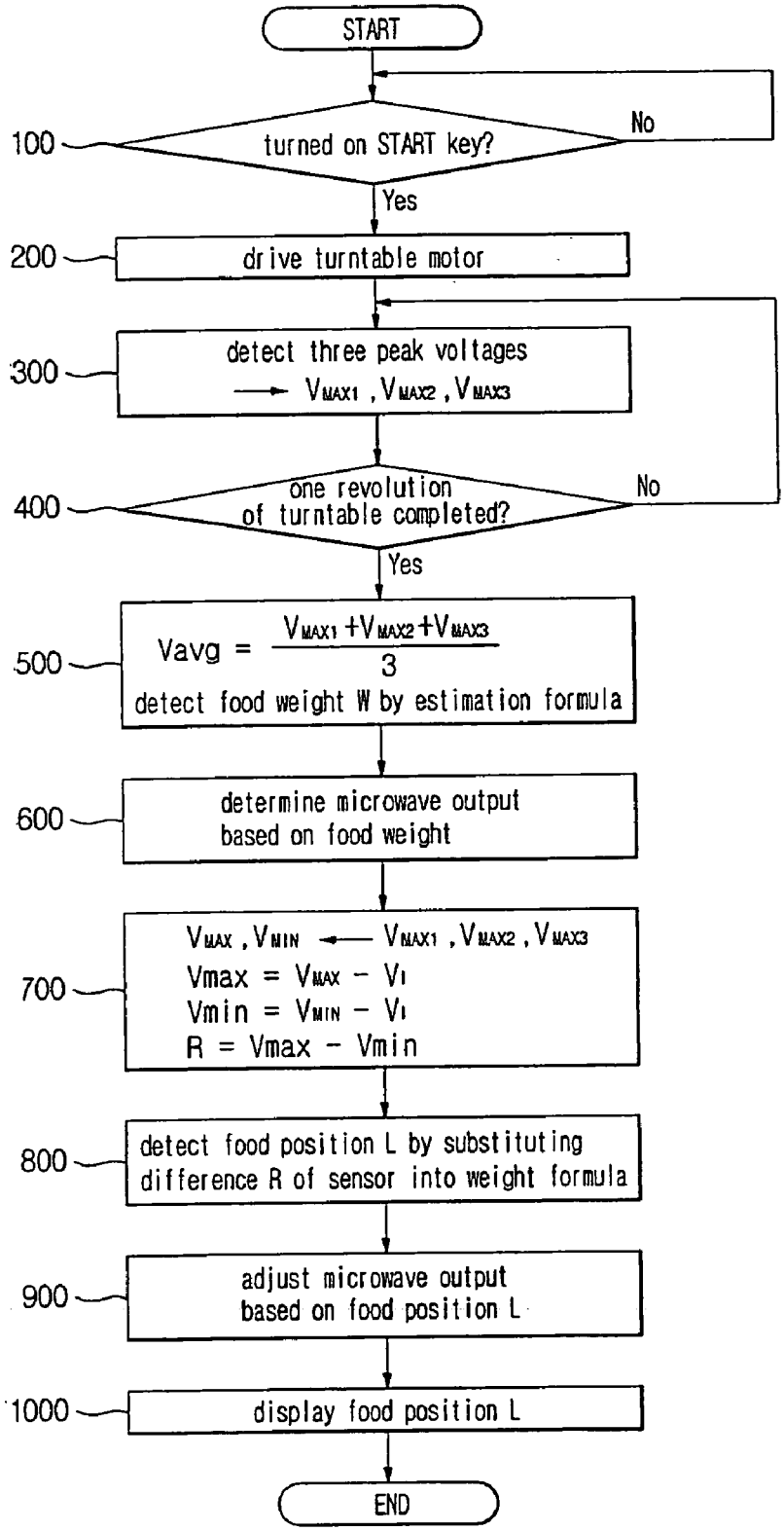
FIG. 6 is a flowchart illustrating a cooking control method of a microwave oven according to an embodiment of the present invention.

FIG. 6 is a flowchart illustrating the cooking control method of the microwave oven according to an embodiment of the present invention.

In operation 100, when the user places food on the turntable 18 in the cavity 12 and presses a start key of the key input part 100, the key signal selected by the user is inputted to the controller 110 by the key input part 100.

From operation 100, the process moves to operation 200, where the controller 110 outputs a control signal for rotating the turntable 18 to the motor driver 130 so as to drive the turntable motor 20.

When the turntable motor 20 is driven, the center coupler 18*a* supporting the turntable 18, rotates on the bottom surface of the cavity 12 and the rollers 22, installed in the lower side of the turntable 18, rotate and travel along the passage together the roller guide 22*b*.

Figure 8:
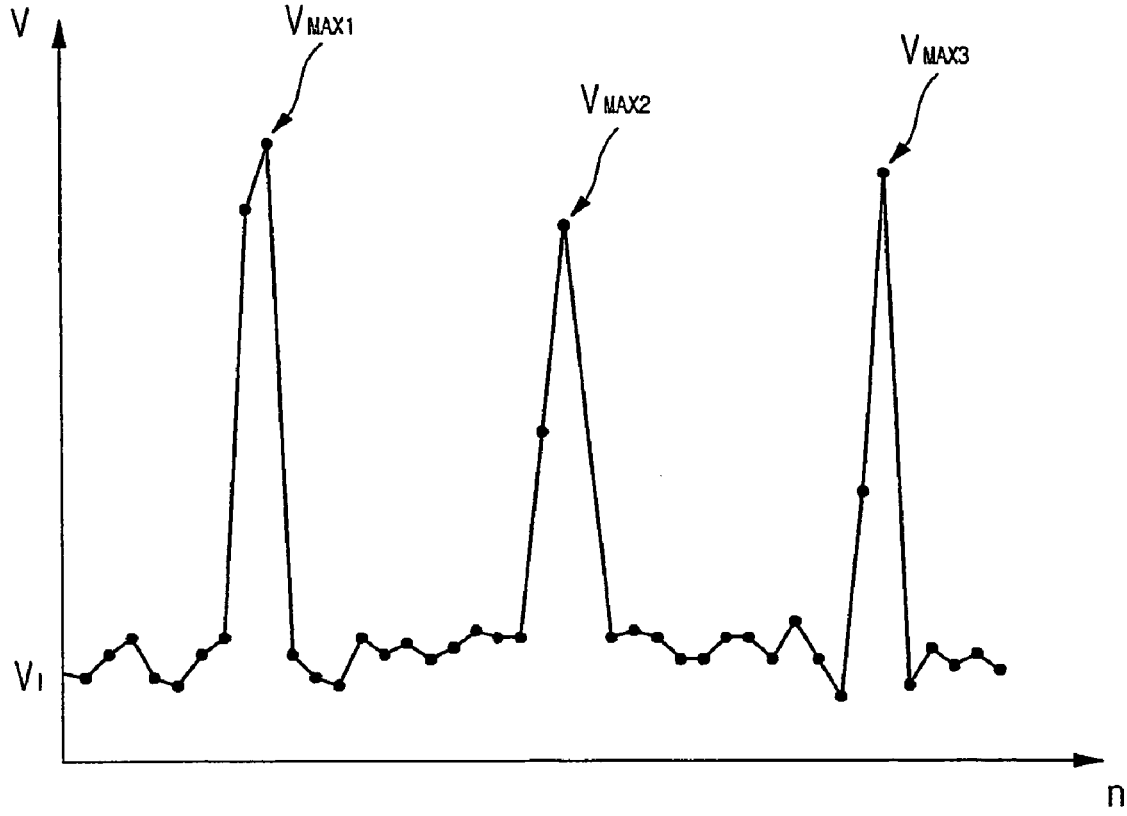
FIG. 8 is a graph illustrating waveforms outputted from a weight sensor of the microwave oven according to an embodiment of the present invention.

When the rollers 22 rotate with the roller guide 22*b*, the weight sensor 24 disposed in the bottom surface of the cavity 12 generates a voltage V when a pressure corresponding to the food weight on the turntable 18 is applied (see FIG. 8).

From operation 200, the process moves to operation 300, where from respective waveforms generated during one time period, for example, when the number of the rollers is three, a maximal value VMAX1 generated from a first waveform, a maximal value VMAX2 generated from a second waveform, and a maximal value VMAX3 generated from a third waveform are detected based on the sensing values sensed by the weight sensor 24 whenever the rollers 22 travel over the weight sensor 24 (see FIG. 8).

For more precise detection of the food weight, the maximal values for two more revolutions (approximately six values) can be detected. From operation 300, the process moves to operation 400, where it is determined if one revolution has been completed. However, the present invention will be described, for example, as if one revolution of the turntable 18 has been completed.

Therefore, when one revolution of the turntable 18 is completed in operation 400, the process moves to operation 500, where the controller 110 detects the food weight by estimating an average voltage value Vavg, an average value of three peak voltage values $V_{MAX1}$, $V_{MAX2}$, and $V_{MAX3}$ generated during one revolution of the turntable 18, and from operation 500, the process moves to operation 600, where the controller 110 determines the output of the microwave based on the detected food weight W.

The output of the microwave based on the food weight W (for example, 500 W, 2 minutes for 2 Kg of food) is inputted in a ROM table of the controller 110. Since the food weight W is the average value of the three peak voltage values VMAX1, VMAX2, and VMAX3, and the detected food weight W is always identical regardless of the position of the food.

From operation 600, the process moves to operation 700, where the controller 110 finds a maximal value among the three peak voltage values VMAX1, VMAX2, and VMAX3, generated for one revolution of the turntable 18 and defines the found maximal value as VMAX, and finds a minimal value among the three peak voltage values VMAX1, VMAX2, and VMAX3, and defines the found minimal value as VMIN.

Further, in operation 700, an initial value V1 of the weight sensor 24 is subtracted from the defined maximal value VMAX and the defined minimal value VMIN, so as to obtain a maximal value Vmax and a minimal value Vmin of the weight sensor 24, and to estimate a difference R between the maximal value Vmax and the minimal value Vmin.

Here, the initial value V1 of the weight sensor 24 indicates an inherent initial voltage value peculiar to the weight sensor 24 and a reference value used to reduce the difference according to microwave ovens and weight sensors.

From operation 700, the process moves to operation 800, where when the estimated difference R is substituted into a formula for determining food weight, the distance from the center of the turntable 18 to food on the turntable 18, i.e., the food position L can be precisely detected, and the formula is inputted to the controller 110 in advance.

The food position on the turntable may be changed, the roller 22, near to the food position, transmits heavy food weight to the weight sensor 24, and the roller 24, far from the food position transmits light food weight to the weight sensor 24, so that the distance of the food from the center of the turntable 18 can be estimated.

From operation 800, the process moves to operation 900, where the output of the microwave is determined based on the detected food position L. When the output of the microwave (for example, the output of the microwave is adjusted to 530 W and 2.5 minutes in the case that the food is positioned 60 mm from the center of the turntable 18 when the food weight is 2 Kg and the output of the microwave is set to 500 W and 2 minutes) is inputted to the ROM table of the controller 110 in advance.

The intensity and amount of energy of the microwave in the cavity 12 are varied whenever food is positioned at the center or the edge of the turntable 18 even if food of same weight W is placed. Thus, since, cooking performance is varied even if the same microwave energy is supplied to food of the same detected food weight W, the food position L is precisely detected and optimized cooking performance is implemented.

From operation 900, the process moves to operation 1000, where the food position L is displayed on the display 140.

Process for detecting the food position L in the cooking control method illustrated in FIG. 6 will be described in detail by referring FIG. 7.

The weight and size of the turntable 18 are determined when a microwave oven is initially developed, and the food position L on the turntable 18 cannot be the same. For example, there is a possibility that, when food is placed at the edge of a turntable 18 of a large diameter, the roller 22, positioned where food is placed on the turntable, transmits a large pressure to the weight sensor 24 during the revolution of the turntable 18, but the roller 22, positioned opposite to the food position, transmits a light food weight to the weight sensor 24. Due to the difference of the diameter and the weight of the turntable 18, there may be different formulas depending upon food (for example, the food weight). In the present invention, five cases will be described by increasing the food weight in 250 g increments.

Figure 7:
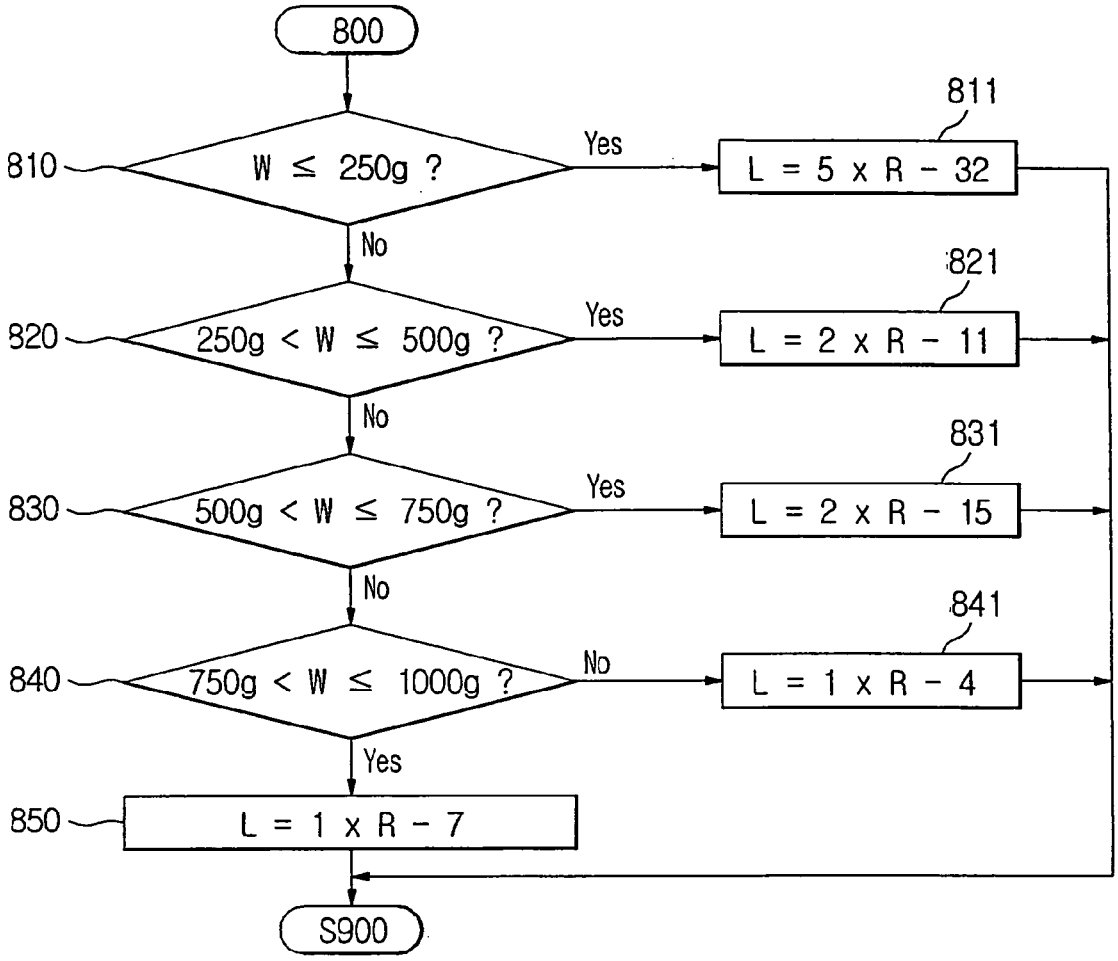
FIG. 7 is a detailed flowchart illustrating a detection of the food position in the cooking control method in FIG. 6.

In FIG. 7, in operation 810, it is determined whether the food weight W is less than 250 g. If it is determined in operation 810, that the food weight W is less than 250 g, the process moves to operation 811, where the difference R of the sensor 24 is substituted to a weight formula ($L=5\times R-32$) so that the distance from the center of the turntable 18 to the food position, that is, the food position L is detected.

If it is determined in operation 810, that the food weight W is not less than 250 g, the process moves to operation 810, where it is determined whether the food weight W is greater than 250 g and less than 500 g. If it is determined in operation 820, that the food weight W is greater than 250 g and less than 500 g, the process moves to operation 821, where the difference R of the sensor 24 is substituted to a weight formula ($L=2\times R-11$) so as to detect the food position L.

However, if it is determined in operation 820, that the food weight W is greater than 250 g and not less than 500 g, the process moves to operation 830, where it is determined whether the food weight W is greater than 500 g and less than 750 g is determined. If the food weight W is greater than 500 g and less than 750 g, the process moves to operation 831, where the difference R of the sensor 24 is substituted to a weight formula ($L=2\times R-15$) so as to detect the food position L.

If it is determined in operation 830, that the food weight W is greater than 500 g and not less than 750 g, the process moves to operation 840, where it is determined whether the food weight W is greater than 750 g and less than 1000 g is determined. If it is determined in operation 840, that the food weight W is greater than 750 g and less than 1000 g, the process moves to operation 841, where the difference R of the sensor 24 is substituted to a weight formula ($L=1\times R-4$) so as to detect the food position L.

If it is determined in operation 840, that the food weight W is greater than 750 g and not less than 1000 g, the process moves to operation 850, where the difference R of the sensor 24 is substituted to a weight formula ($L=1\times R-7$) so as to detect the food position L.

Since the intensity and amount of energy of the microwave are different according to the food position, the cooking performance is changed when the same microwave energy is supplied even if the same food weight W is detected. As a result, consumers may be dissatisfied with the conventional microwave oven and manufacturers lose a chance to provide a better microwave oven.

Thus, if the microwave energy in the microwave oven is measured and programmed based on the food position when developing the microwave oven, the user can experience uniform and optimized cooking performance regardless of the food position.

Although, in the embodiment of the present invention, the detection of the food weight W and the food position L using the sensing values of the weight sensor 24 generated due to the three contacts of the weight sensor 24 for one revolution of the turntable 18 has been described as an example. The present invention is not limited to hereto and the same aspect and effect as those of the present invention can be achieved even when the food weight W and the food position L are detected using the sensing values for two revolutions or more.

Moreover, regardless of the food position, the boomerang effect that food is always positioned in front of the door 14 when the cooking is finished can be implemented by detecting the food position by the weight sensor 24.

As described above, according to the microwave oven cooking control method and the apparatus for performing the same according to the present invention, optimized cooking performance can be implemented by controlling the microwave output based on the food weight and the food position, and microwaves of proper energy can be supplied to food based on the food position by precisely detecting the food position on the turntable using the weight sensor.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A control method for cooking food placed on a turntable in a microwave oven, comprising:

detecting a plurality of sensing values generated according to a weight of food to be cooked during the rotation of the turntable;

detecting a food position by comparing the detected sensing values; and controlling the microwave output based on the detected food position, wherein the food position is estimated by obtaining a maximal value and a minimal value among the detected sensing values and by substituting a difference between the maximal value and the minimal value into a weight formula, the maximal value is a maximal voltage value obtained by subtracting an initial voltage value from a greatest value among the detected sensing values and the minimal value is a minimal voltage value obtained by subtracting the initial voltage value from a lowest value among the detected sensing values, wherein the weight formula varies according to the weight of the food.

2. The control method according to claim 1, wherein the sensing values are peak voltage values detected according to a pressure applied corresponding to the weight of food.

3. The control method according to claim 2, wherein the sensing values are peak voltage values detected for a period of one revolution of the turntable.

4. The control method according to claim 2, wherein the sensing values are peak voltage values detected for a period of at least two revolutions of the turntable.

5. The control method according to claim 1, wherein the food position is a distance of the food from a center of the turntable.

6. The control method according to claim 5, wherein the output of the microwave is increased as the food position is farther from the center of the turntable.

7. The control method according to claim 1, wherein the food weight is a value corresponding to an average of the sensing values and is detected as a same value regardless of the food position.

8. The control method according to claim 1, wherein the weight formula is predetermined.

9. The control method according to claim 1, wherein the weight formula is $L=5\times R-32$ when the weight is less than a first predetermined weight, wherein L is the food position and R is the difference.

10. The control method according to claim 9, wherein the weight formula is $L=2\times R-11$ when the weight is not less than the first predetermined weight and less than a second predetermined weight.

11. The control method according to claim 9, wherein the weight formula is $L=2\times R-15$ when the weight is not less than the second predetermined weight and less than a third predetermined weight.

12. The control method according to claim 11, wherein the weight formula is $L=R-4$ when the weight is not less than the third predetermined weight and less than a fourth predetermined weight.

13. The control method according to claim 12, wherein the weight formula is $L=1\times R-7$ when the weight is not less than the fourth predetermined weight.

14. A controlling apparatus of a microwave oven for cooking food placed on a turntable, comprising:

a weight sensor to detect a plurality of sensing values generated according to food weight during a rotation of the turntable; and a controller to detect the food position by comparing the detected sensing values, and to control the microwave output based on the detected food position, wherein the food position is estimated by obtaining a maximal value and a minimal value among the detected sensing values and by substituting a difference between the maximal value and the minimal value into a weight formula, the maximal value is a maximal voltage value obtained by subtracting an initial voltage value from a greatest value among the detected sensing values and the minimal value is a minimal voltage value obtained by subtracting the initial voltage value from a lowest value among the detected sensing values, wherein the weight formula varies according to the weight of the food.

15. The controlling apparatus according to claim 14, wherein the controller controls the microwave output intensity and microwave output time based on the food position.

16. The controlling apparatus according to claim 14, wherein the sensing values are peak voltage values detected when a plurality of rollers that are installed in a lower side of the turntable travels over the weight sensor, according to a pressure applied corresponding to the weight of food.

17. The controlling apparatus according to claim 16, wherein a number of the rollers is three, each roller disposed radially every 120 degrees.

18. A method for controlling a microwave oven having a weight sensor and a plurality of rollers, the method comprising:

detecting a weight of food by sensing a plurality of values each generated when a respective roller travels across the weight sensor;

determining a position of the food based upon a comparison between the plurality of values sensed; and controlling an output of the microwave based upon the determined position of the food, wherein the determining of the position of the food comprises:

obtaining a maximum value and a minimum value of the plurality of values generated;

calculating a difference between the maximum value and the minimum value; and substituting the difference into a predetermined weight formula to determine a value corresponding to the position of the food, wherein the weight formula varies according to the weight of the food.

19. The method of claim 18, further comprising generating voltage when a pressure is applied to the weight sensor by a respective roller, the pressure corresponding to the weight of the food, and each sensed value corresponding to a generated voltage.

20. The method of claim 18, wherein the detecting the weight of the food comprises:

determining whether one rotation has been completed by the rollers;

detecting the weight of the food by averaging the plurality of values generated during the one revolution; and determining the output of the microwave based on the detected weight of the food.

* * * * *